US011078755B2

(12) United States Patent
Mujica et al.

(10) Patent No.: US 11,078,755 B2
(45) Date of Patent: Aug. 3, 2021

(54) HIPS PROOF TESTING IN OFFSHORE OR ONSHORE APPLICATIONS

(71) Applicant: Saudi Arabian Oil Company, Dhahran (SA)

(72) Inventors: Pedro Alejandro Mujica, Dammam (SA); Herman Roberto Cipriano, Al Khobar (SA); Michael Anthony Picou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 238 days.

(21) Appl. No.: 16/437,810

(22) Filed: Jun. 11, 2019

(65) Prior Publication Data

US 2020/0392816 A1 Dec. 17, 2020

(51) Int. Cl.

| | |
|---|---|
| ***E21B 41/00*** | (2006.01) |
| ***E21B 47/008*** | (2012.01) |
| ***E21B 43/12*** | (2006.01) |
| ***E21B 47/06*** | (2012.01) |

(52) U.S. Cl.

CPC ..... *E21B 41/0021* (2013.01); *E21B 41/0092* (2013.01); *E21B 43/128* (2013.01); *E21B 47/008* (2020.05); *E21B 47/06* (2013.01)

(58) Field of Classification Search

CPC .... E21B 41/0092; E21B 43/128; E21B 47/06; E21B 43/12; E21B 47/008; E21B 41/0021; F17D 5/00

See application file for complete search history.

(56) References Cited

U.S. PATENT DOCUMENTS

| | | | |
|---|---|---|---|
| 4,215,746 | A | 8/1980 | Hallden et al. |
| 5,446,369 | A | 8/1995 | Byrne et al. |
| 5,887,657 | A | 3/1999 | Bussear et al. |
| 6,556,027 | B2 | 4/2003 | Banks |
| 6,880,567 | B2 | 4/2005 | Klaver et al. |
| 7,044,156 | B2 | 5/2006 | Vetco |
| 7,133,727 | B2 | 11/2006 | Van Dyk et al. |
| 7,823,640 | B2 | 11/2010 | Flanders |
| 8,051,875 | B2 | 11/2011 | Edwards |
| 8,161,993 | B2 | 4/2012 | Radcliffe |

(Continued)

FOREIGN PATENT DOCUMENTS

| | | |
|---|---|---|
| CN | 101369152 | 2/2009 |
| CN | 105239993 | 1/2016 |

(Continued)

OTHER PUBLICATIONS

International Search Report and Written Opinion issued in International Application No. PCT/US2018/018976 dated May 4, 2018, 15 pages.

(Continued)

*Primary Examiner* — Michael R Wills, III
(74) *Attorney, Agent, or Firm* — Fish & Richardson P.C.

(57) ABSTRACT

Systems, methods, and devices for maintaining production during proof testing of a safety system are disclosed. More particularly, systems, methods, and devices for maintaining production of fluids, such as hydrocarbons or water, during proof testing of High Integrity Protection Systems (HIPS) used to prevent overpressure scenarios during production, such as production of fluid by artificial lift, are described.

20 Claims, 9 Drawing Sheets

(56) References Cited

U.S. PATENT DOCUMENTS

| | | | |
|---|---|---|---|
| 8,201,624 | B2 | 6/2012 | Flanders |
| 8,327,874 | B2 | 12/2012 | Flanders |
| 8,616,230 | B2 | 12/2013 | Studer |
| 8,725,434 | B2 | 5/2014 | Flanders |
| 8,776,609 | B2 | 7/2014 | Dria et al. |
| 10,221,645 | B2 | 3/2019 | Elliott |
| 2005/0122121 | A1 | 6/2005 | Gilboe |
| 2005/0199286 | A1 | 9/2005 | Appleford et al. |
| 2008/0000529 | A1 | 1/2008 | Edwards |
| 2008/0156077 | A1 | 7/2008 | Flanders |
| 2009/0013807 | A1 | 1/2009 | Webster |
| 2009/0101338 | A1 | 4/2009 | Flanders |
| 2009/0260829 | A1 | 10/2009 | Mathis |
| 2011/0061861 | A1 | 3/2011 | Flanders |
| 2011/0133942 | A1 | 6/2011 | Flanders |
| 2011/0144946 | A1 | 6/2011 | Flanders |
| 2014/0039648 | A1 | 2/2014 | Boult et al. |
| 2014/0114577 | A1 | 4/2014 | Lopezgarcia et al. |
| 2014/0212978 | A1 | 7/2014 | Sharpe |
| 2014/0214326 | A1 | 7/2014 | Samuel et al. |
| 2014/0261778 | A1 | 9/2014 | Hamilton |
| 2015/0027730 | A1 | 1/2015 | Hall et al. |
| 2015/0184497 | A1 | 7/2015 | Whitby |
| 2017/0089182 | A1 | 3/2017 | Witwer et al. |
| 2017/0328827 | A1* | 11/2017 | Mujica ..... G01N 17/00 |
| 2017/0329356 | A1 | 11/2017 | McKeon et al. |
| 2018/0156004 | A1 | 6/2018 | Hussain |
| 2018/0245452 | A1 | 8/2018 | Mujica |
| 2018/0298738 | A1 | 10/2018 | Mujica et al. |
| 2019/0219230 | A1 | 7/2019 | Simon |
| 2019/0294183 | A1* | 9/2019 | Al Khunaizi ..... F17D 5/00 |
| 2019/0294184 | A1* | 9/2019 | Al Khunaizi ..... G01M 3/2815 |

FOREIGN PATENT DOCUMENTS

| | | |
|---|---|---|
| CN | 105910088 | 8/2016 |
| EP | 2592318 | 5/2013 |
| EP | 3054203 | 8/2016 |
| JP | 2005308841 | 11/2005 |
| JP | 2009544008 | 12/2009 |
| JP | 2011053161 | 3/2011 |
| WO | WO 2007132725 | 11/2007 |
| WO | 2012054295 | 4/2012 |
| WO | 2012100044 | 7/2012 |
| WO | 2017196420 | 11/2017 |
| WO | 2017218547 | 12/2017 |
| WO | 2018037084 | 3/2018 |

OTHER PUBLICATIONS

International Search Report and Written Opinion of the International Searching Authority issued in International Application No. PCT/US2017/018048 dated May 2, 2017; 14 pages.

International Search Report and Written Opinion issued in International Application No. PCT/US2018/027134 dated Jul. 6, 2018, 16 pages.

European Communication Pursuant to Rules 161(1) and 162 EPC issued in European Application No. 17708369.8 dated Dec. 18, 2018, 3 pages.

Dutuit, Y., et al.; "Probabilistic Assessments in Relationship with Safety Integrity Levels by Using Fault Trees"; Reliability Engineering and System Safety, Elsevier Applied Science; vol. 93, No. 12; Dec. 1, 2008; pp. 1867-1876.

George, "Subsea Production Equipment Standardisation Initiative," Offshore Technology Conference, OTC-8179-MS, 1996, 2 pages (Abstract only).

Summers, "Wellhead Flowline Pressure Protection using High Integrity Protective Systems (HIPS)," SIS Tech, available on or before 2017, 7 pages.

Woods, "Generating Project Value Through Design for Reliability: On the Development and Implementation of a Potential Value Framework," Thesis submitted for degree of Engineering Doctorate at Cranfield University, Oct. 2007, 274 pages.

Gulf Cooperation Council Examination Report issued in GCC Application No. GC 2017-33199 dated Mar. 19, 2019, 5 pages.

PCT International Search Report and Written Opinion in International Application No. PCT/US2020/037,166, dated Oct. 2, 2020, 15 pages.

Gulf Cooperation Council Examination Report issued in GCC Application No. GC2018-35146 dated Oct. 7, 2020, 4 pages.

CN Office action in Chinese Appln. No. CN 201880026050.3, dated Feb. 19, 2021, 17 pages, with English Translation.

JP Office action in Japanese Appln. No. JP 2018-559703, dated Feb. 10, 2021, 8 pages, with English Translation.

Gulf Cooperation Council Examination Report issued in GCC Application No. GC2018-34815 dated Sep. 10, 2019, 4 pages.

Gulf Cooperation Council Examination Report issued in GCC Application No. GC2017-33199 dated Sep. 24, 2019, 5 pages.

* cited by examiner

HIPS PROOF TESTING IN OFFSHORE OR ONSHORE APPLICATIONS

TECHNICAL FIELD

This present disclosure relates to proof testing of a safety system.

BACKGROUND

A High Integrity Protection System (HIPS) is a type of safety instrumented system that operates to prevent over-pressurization of a production system. When an over-pressurization scenario is detected, a HIPS shuts down the source or sources causing the over-pressurization in order to prevent catastrophic failure of a portion of the production system for which the pressures being generated exceed operating limits of a portion or portions of the production system, such as a downstream system. In some cases, the operating limits may represent operational design limits or mechanical design limits. A HIPS is periodically tested to ensure minimum reliability requirements are maintained. Currently, performance of this testing interrupts production.

SUMMARY

An aspect of the present disclosure is directed to a control system for maintaining a production fluid flow during proof testing of a High Integrity Protection System (HIPS). The control system may include a HIPS and an auxiliary system. The HIPS may include a first pressure sensor operable to sense a fluid pressure of the production fluid flow; a first circuit breaker operable selectively to open to prevent a flow of electrical power along the first electrical path or close to permit the flow of electrical power along the first electrical path; and a first data processor. The first data processor may be operable to receive a first pressure signal from the first pressure sensor, the pressure signal indicative of a fluid pressure of a production fluid flow; compare the received first pressure signal to a predetermined fluid pressure to determine the presence of an overpressure condition of the production fluid flow; and open the first circuit breaker to discontinue the production fluid flow if the received first pressure signal meets or exceeds the predetermined fluid pressure. The auxiliary system may include a second circuit breaker arranged in a bypass of the first electrical path. The second circuit breaker may be operable selectively to open to prevent a flow of electrical power along the bypass and close to permit the flow of electrical power along the bypass. The auxiliary system may be operable to close the second circuit breaker prior to the first circuit breaker being opened by the first data processor in response to a test pressure signal received by the first data processor from the first pressure sensor during the proof test.

According to another aspect, the present disclosure is directed to a method of maintaining a production fluid flow during proof testing of a HIPS. The method may include forming a bypass of a first electrical path that extends between a power source and a pump, the first electrical path being selectively opened or closed by the HIPS in response to a pressure condition of the production fluid flow; initiating proof testing of the HIPS such that the HIPS detects an overpressure condition and opens the first electrical path; and maintaining flow of electrical power from the power source to the pump along the bypass prior to the first electrical path being opened.

According to a further aspect, the present disclosure is directed to a computer program product encoded on a non-transitory medium. The product includes computer readable instructions for causing one or more processors to perform operations that may include forming a bypass of a first electrical path that extends between a power source and a pump, the first electrical path being selectively opened or closed by the HIPS in response to a pressure condition of the production fluid flow; initiating proof testing of the HIPS such that the HIPS detects an overpressure condition and opens the first electrical path; and maintaining flow of electrical power from the power source to the pump along the bypass when the first electrical path is open.

The various aspects may include one or more of the following features. The auxiliary system may also include a second data processor and a second pressure sensor. The second data processor may be operable to receive a pressure signal from the second pressure signal of the production fluid flow during the HIPS proof testing. The second data processor may be operable to open the second circuit breaker when the second pressure signal exceeds the predetermined fluid pressure. The first data processor and the second data processor may be the same data processor. The HIPS may include a third circuit breaker coupled to the first data processor, and the first circuit breaker and the third circuit breaker may operate in a one-out-of-two (1oo2) channel voting arrangement. The HIPS may include a third pressure sensor coupled to the first data processor, and the first pressure sensor and the second pressure sensor may operate in a 1oo2 channel voting arrangement. The HIPS may include a fourth pressure sensor coupled to the first data processor. The first pressure sensor, the third pressure sensor, and the fourth pressure sensor may operate in a two-out-of-three (2oo3) channel voting arrangement. The first pressure sensor and the second pressure sensor may be pressure transducers. An electric submersible pump may be operable to generate the production fluid flow. The electric submersible pump may be coupled to the first electrical path and the bypass.

The various aspects may also include one or more of the following features. Forming a bypass of the first electrical path may include closing a circuit breaker disposed on a second electrical path that bypasses the first electrical path. The closed circuit breaker may permit the flow of electrical power along the second electrical path. Initiating proof testing of the HIPS may include receiving an simulated production fluid pressure signal by the HIPS; comparing the simulated production fluid pressure signal to a predetermined fluid pressure indicative of an overpressure condition; and opening the first electrical path to prevent passage of electrical power along the first electrical path when the simulated production fluid pressure meets or exceeds the predetermined fluid pressure. Receiving a simulated production fluid pressure signal by the HIPS may include receiving the simulated production fluid pressure from a first pressure sensor of the HIPS by a data processor of the HIPS. Comparing the simulated production fluid pressure to the predetermined fluid pressure indicative of an overpressure condition may include comparing the simulated fluid pressure to the predetermined fluid pressure with the data processor. Opening the first electrical path to prevent passage of electrical power along the first electrical path when the simulated production fluid pressure meets or exceeds the predetermined fluid pressure may include opening a circuit breaker in the first electrical path in response to a signal sent by the data processor. The first pressure sensor may form a part of a two-out-of-three (2oo3) channel voting arrangement. The circuit breaker may form a part of a one-out-of-two (1oo2) channel voting arrangement.

The different aspects may also include one or more of the following features. Forming a bypass of the first electrical path may include closing a circuit breaker disposed on a second electrical path that bypasses the first electrical path. The closed circuit breaker may permit flow of electrical power along the second electrical path. Receiving a simulated production fluid pressure signal by the HIPS may include receiving the simulated production fluid pressure from a first pressure sensor of the HIPS by a data processor of the HIPS. Comparing the simulated production fluid pressure to the predetermined fluid pressure indicative of an overpressure condition may include comparing the simulated fluid pressure to the predetermined fluid pressure with the data processor. Opening the first electrical path to prevent passage of electrical power along the first electrical path when the simulated production fluid pressure meets or exceeds the predetermined fluid pressure may include opening a circuit breaker in the first electrical path in response to a signal sent by the data processor.

The details of one or more embodiments of the present disclosure are set forth in the accompanying drawings and the description that follows. Other features, objects, and advantages of the present disclosure will be apparent from the description and drawings, and from the claims.

DESCRIPTION OF DRAWINGS

Like reference symbols in the various drawings indicate like elements.

DETAILED DESCRIPTION

Figure 1:
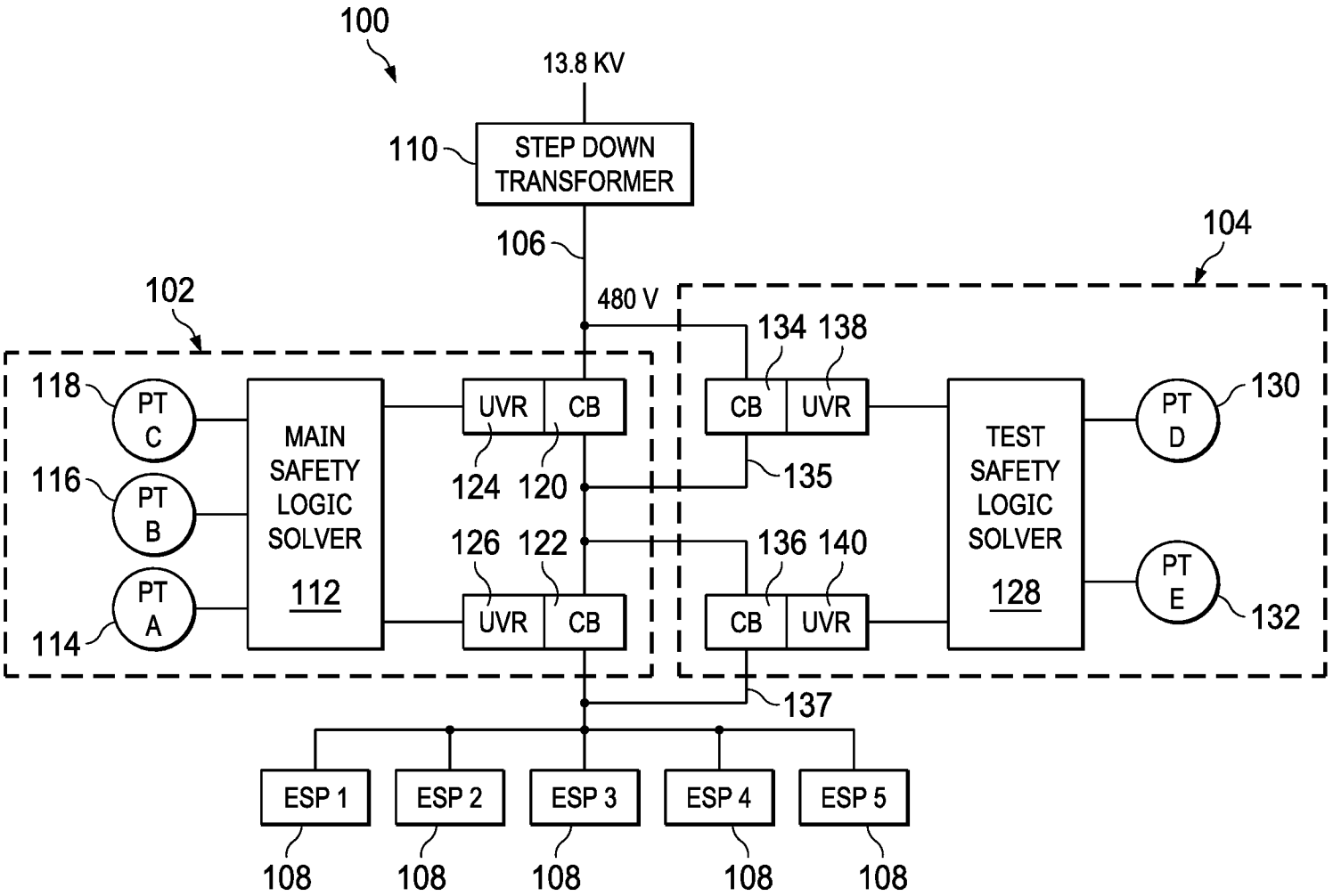
FIG. 1 is a schematic diagram of an example system for control or safety, or both that includes a High Integrity Protection System (HIPS) along with an auxiliary system that uses a one-out-of-two (1oo2) channel voting arrangement for pressure sensing and a 1oo2 channel voting arrangement for circuit breaker control to maintain operation of production during proof testing of the HIPS, according to some implementations of the present disclosure.

For the purposes of promoting an understanding of the principles of the present disclosure, reference will now be made to the example implementations illustrated in the drawings, and specific language will be used to describe the same. Nevertheless, no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, steps, or a combination of such described with respect to one implementation may be combined with the features, components, steps, or a combination of such described with respect to other implementations of the present disclosure.

The present disclosure describes systems, methods, and devices for maintaining production of a production system during proof testing of a High Integrity Protection Systems (HIPS). A HIPS may be installed, for example, on an offshore platform and is designed to avoid an increase in pressure that could potentially harm a downstream system, such as downstream piping. For example, harm may be in the form of loss of containment in the downstream system. In some implementations, the present disclosure is directed to maintaining operation of electric submersible pumps (ESPs) during proof testing of a HIPS and, therefore, maximize production and prevent loss revenue during proof testing of a HIPS. Examples described are related to ESPs in the context of offshore platforms, such as petroleum offshore platforms. However, the scope of the disclosure is not limited to offshore applications. Rather, the systems, methods, and devices described are applicable to onshore production (such as onshore petroleum production) as well as to industries outside of the petroleum industry. With the methods, systems, and devices described in the present disclosure, production is maintained and shutdown and startup of pumping devices, such as electric submersible pumps, is reduced or eliminated. Although examples described in the present disclosure are provided in the context of oil production, the present disclosure is not so limited. Rather, the concepts disclosed are applicable to production of any fluid type, such as water.

To maintain a desired Safety Integrity Level (SIL) of a HIPS, proof testing of the HIPS is generally preformed on a regular basis, such as on a pre-determined frequency. For a particular application, regular proof testing of a HIPS may be mandatory. However, conventionally, proof testing of a HIPS results in production downtime due to the shutdown of pumps, such as ESPs, used for production. For example, in the context of an offshore production system, HIPS proof testing causes production downtime, whether for a single well or a cluster of wells, due to stoppage of the ESPs. With production stopped during testing, there arises a potential for revenue loss. These potential losses are cumulative and may be considerable over an entire lifecycle of a producing field. Control systems within the scope of the present disclosure may be provided with any desired safety integrity level.

In order to maximize production and avoid these potential revenue losses, a bypass system operable to maintain operation of ESPs (and, hence, maintain production) during proof testing of a HIPS is provided. FIG. 1 is an example control system 100 that is operable to maintain both production and operational safety during HIPS proof testing. The control system 100 is an electrical system that includes a HIPS 102 and an auxiliary system 104. The HIPS 102 and auxiliary system 104 connect to a power line 106 that supplies electrical power to a plurality of ESPs 108. Although five ESPs 108 are shown, additional or fewer ESPs 108 may be used. In the illustrated example, the electrical line 106 provides power from a stepdown transformer 110. In this example, the stepdown transformer 110 steps down a higher voltage, such as 13.8 kilovolts (kV), to a lower voltage, such as 480 volts (V). The lower voltage is used to operate the ESPs 108. However, in other implementations, the stepdown transformer 110 may be omitted. Still further, in implementations where a stepdown transformer is included, the incoming voltage and the outgoing voltage may be different than those provided in the example of FIG. 1. In this example, the HIPS 102 operates at a level three SIL, and the auxiliary system 104 operates at a three two SIL. In other implementations, the HIPS 102 and auxiliary system 104 may operate with different SIL levels. Still further, in some implementations, the HIPS 102 and the auxiliary system 104 may be integrated into a unitary system for control, safety, or both.

The HIPS 102 includes a main or primary safety logic solver (SLS) 112 coupled to pressure transducers (PTs) 114, 116, and 118. Although pressure transducers are described, other sensors operable to detect pressure changes may also be used. The HIPS 102 also includes a first circuit breaker (CB) 120 and a second CB 122 coupled to the power line 106. Also part of the HIPS 102 is a first under-voltage relay (UVR) 124 coupled to the first CB 120 and a second UVR 126 coupled to the second CB 122. The three PTs 114, 116, and 118 operate in a two-out-of-three ("2oo3") channel voting arrangement. In such an arrangement, two of the three channels are required to operate properly (that is, accurately detecting an abnormal process condition) in order for the HIPS 102 to function as intended. Thus, a failure of one or two of the PTs would still enable operation of the HIPS 102. The 2oo3 channel voting arrangement for the PTs is provided only as an example. In other implementations, other arrangements may be used and are within the scope of the present disclosure. For example, in some instances, any number of PTs may be used in any desired voting arrangement. A channel voting arrangement, such as a 1oo2 or 2oo3 channel voting arrangement, is a redundancy configuration that enable continued operation when one or more elements experience a failure or are otherwise unable to continue operation.

The two CBs 120 and 122 and associated UVRs 124 and 126 form a one-out-of-two (1oo2) channel voting arrangement. In a 1oo2 arrangement, at least one of the channels is required to work properly in order for the HIPS 102 to function as intended. Thus, a failure of one of a CB or UVR or both of a single channel will still permit the HIPS 102 to operate correctly. While a 1oo2 channel voting arrangement is shown, other arrangements may also be used and are within the scope of the present disclosure. For example, in some implementations, a one-out-of-one (1oo1) channel voting arrangement may be used.

The PTs 114, 116, and 118 sense a pressure of a fluid flow, such as liquid petroleum. The PTs 114, 116, and 118 may be disposed in manifold, for example. In other instances, the PTs may be disposed in one or more other fluid flow conduits. The SLS 112 receives the sensed pressure signals from each of the PTs 114, 116, and 118. The SLS 112 includes logic that, for example, compares the sensed pressures in a 2oo3 voting arrangement to a predetermined pressure. The predetermined pressure may be any selected pressure. For example, the predetermined pressure may be a design pressure. The design pressure may be a maximum allowable pressure or a threshold pressure that may be lower than a maximum allowable pressure. For example, in some implementations, the predetermined pressure may be a maximum allowable operating pressure of a downstream piping network or system. If the sensed pressure is less than the predetermined pressure, the UVRs 124 and 126 remain energized and the CBs 120 and 122 remain closed, and power to the ESPs 108 is maintained. If the sensed pressure is at or above the predetermined pressure, the SLS 112 de-energizes the UVRs 124 and 126, thereby opening the CBs 120 and 122. With CBs 120 and 122 open, electrical power to the ESPs 108 is prevented, and the ESPs 108 cease operation. Operation of HIPS 102 to open CBs 120 and 122 in response to a detected pressure may also involve the signaling of an alarm (such as an audible alarm, a visual alarm, or tactile alarm) to alert a user. In some instances, the user may be located locally. In other instances, the user may be located remotely and in communication via a wired or wireless communication connection. As illustrated, should one or both components of a UVR and CB pair malfunction or otherwise be inoperable, the other, redundant UVR and CB pair is still capable of stopping flow of electrical power to the ESPs 108.

During proof testing, simulated test pressure signals exceeding the predetermined pressure are sent to an SLS of a HIPS to ensure that the associated CBs open in response, thereby ensuring proper operation of the HIPS. The simulated test pressure signals represent a simulated pressure of a production fluid flow. To verify that the HIPS has performed properly by opening the CBs, one or more voltage measurements, current measurements may be made across the CBs to verify whether the CBs are open or closed. In other implementations, one or more mechanical position indications may be determined to indicate whether the CBs are open or closed. Ordinarily, though, this testing stops operation of the ESPs when the CBs open. As a result, a production stops and a potential for lost revenue arises. However, in the example control system 100, the auxiliary system 104 operates to permit continuous operation of the ESPs 108 during proof testing of the HIPS 102.

The auxiliary system 104 includes a test SLS 128 that receives pressure signals from PTs 130 and 132 that are arranged in a 1oo2 channel voting arrangement. In other implementations, additional or fewer PTs may be used, and, in other implementations, the PTs may have a different arrangement. The auxiliary system 104 also includes CBs 134 and 136 and associated UVRs 138 and 140. The CB 134 is arranged in a bypass 135 that bypasses CB 120, and CB 136 is arranged in a bypass 137 that bypasses CBs 122. The CBs 134 and 136 and associated UVRs 138 and 140 operate in a 1oo2 channel voting arrangement. However, a different number of CBs and UVRs may be used, and a different arrangement of these components may be used.

The SLS 128 may operate in a manner similar to that of the SLS 112. Specifically, during proof testing, if the pressure signals sensed by the PTs 130 and 132, representing actual production fluid pressure, are under a predetermined pressure, the SLS 128 keeps the UVRs 138 and 140 energized, which, in turn, keeps the CBs 134 and 136 closed. As a result, power to the ESPs 108 is maintained. If the pressure signals from the PTs 130 and 132 are at, or exceed, the predetermined pressure, the SLS 128 de-energizes the UVRs 138 and 140, causing the CBs 134 and 136 to open. In some implementations, the SLS 128 may also send a trip signal to the SLS 112 to cause the UVRs 124 and 126 to de-energize and open CBs 120 and 122, respectively, As a result, power is prevented from passing through CBs 120, 122, 134, and 136. Consequently, power to the ESPs 108 is prevented, and the ESPs 108 cease operation. As shown, the auxiliary system 104 includes two paired sets of UVRs and CBs. Thus, if one set were to fail, the other would still be operable to stop the flow of electrical power to the ESPs 108.

As shown in FIG. 1, the CBs 134 and 136 bypass the respective CBs 120 and 122. During proof testing of the HIPS 102, simulated test pressures that meet or exceed a predetermined pressure are sent to the SLS 112, causing the CBs 120 and 122 open. The simulated test pressures are sent to the SLS 112 via one or more or all of the PTs 114, 116, and 118. In some instances, one or more voltage measurements may be made across the CBs 120 and 122 to verify whether the CBs 120 and 122 are open or closed. In other implementations, one or more current measurements relative to the CBs 120 and 122 or one or more mechanical position indications relative to the CBs 120 and 122 may be made to verify on open or closed status of the CBs 120 and 122. However, the CBs 134 and 136 remain closed and bypass the open CBs 120 and 122 so long as the sensed pressures from the PTs 130 and 132 remain below a predetermined pressure. Consequently, with the control system 100, electrical power to the ESPs 108 is maintained during proof testing of the HIPS 102. Moreover, during proof testing of the HIPS 102, the safety integrity level may be provided via the auxiliary system 104. For example, the auxiliary system 104 may be configured to have a 1oo1, 1oo1 a 1oo2, 2oo3, or any other voting arrangement. Further, the auxiliary system 104 may have any desired safety integrity level. This desired SIL may be provided just in case an actual overpressure condition occurs during HIPS proof testing. If such an overpressure condition does develop during proof testing of HIPS 102, the auxiliary system 104 is operable to detect the overpressure condition and, in response, cut off power to ESPs 108.

Although the control system 100 includes separate SLSs 112 and 128, in other implementation, a single SLS may be used. Further, in the illustrated example, each of the HIPS 102 and the auxiliary system 104 has a set of pressure transducers. In other implementations, the HIPS 102 and the auxiliary system 104 may share the same pressure transducers. This sharing of pressure transducers may be used where separate SLSs are used for each of the HIPS 102 and auxiliary system 104 or where a common SLS is used for the HIPS 102 and auxiliary system 104. In implementations utilizing common PTs, a selector switch may be incorporated to select which PT is to be tested and serve as a tripping transmitter for the SLS of the auxiliary system.

Figure 2:
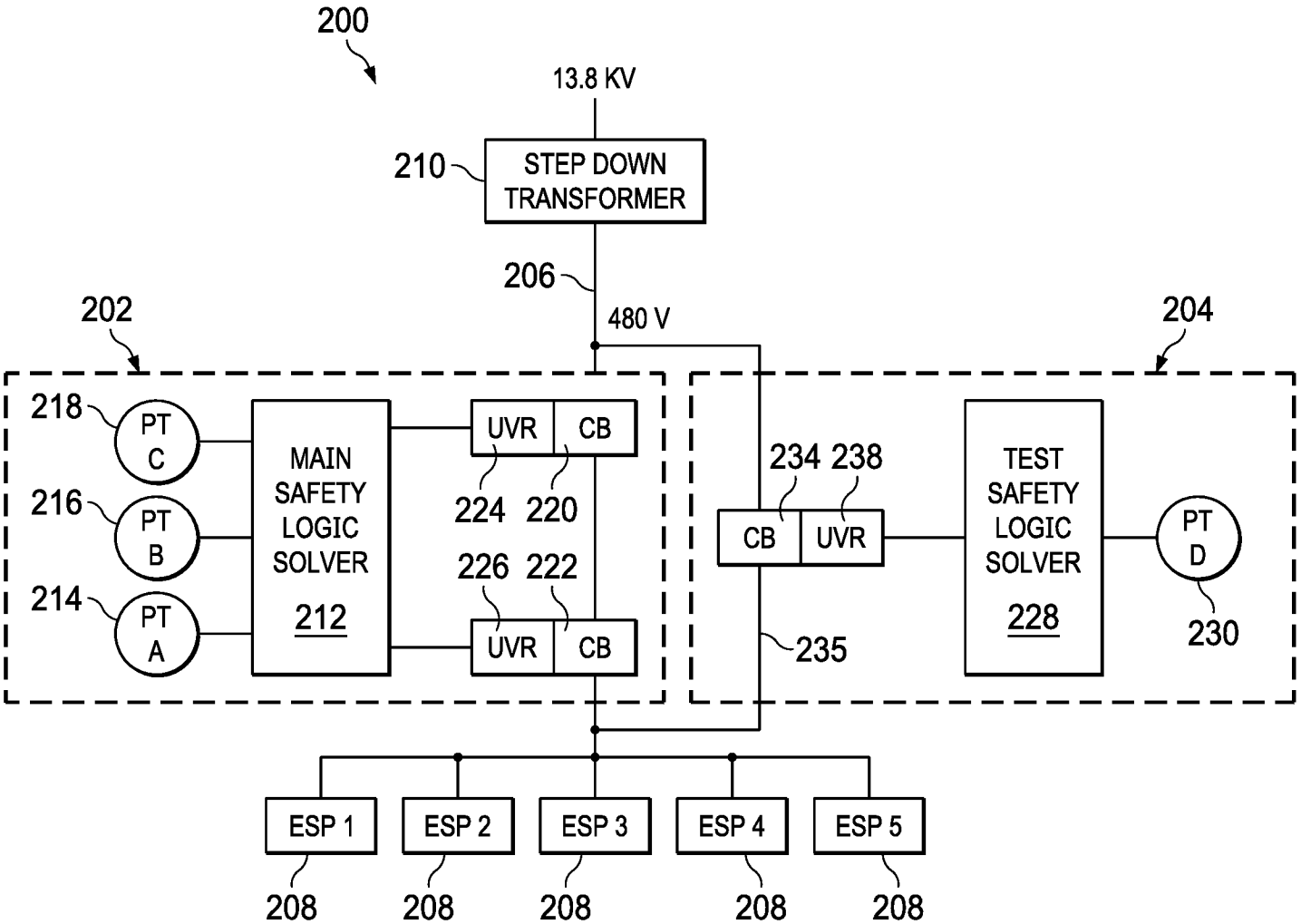
FIG. 2 is a schematic diagram of another control system in which an auxiliary system uses one-out-of-one (1oo1) channel voting arrangements for pressure sensing and circuit breaker control to maintain production during proof testing of a HIPS, according to some implementations of the present disclosure.

Additionally, FIGS. 1 and 2 illustrate the pressure transducers, circuit breakers and under-voltage relays as being coupled to the respective safety logic solvers via wired connections. However, wireless connections may be used with some or all of the components of the HIPSs and auxiliary systems provided in the present disclosure. In some implementations, safety-certified wireless connections may be used.

While SLSs are described, other types of logic devices may be used in the HIPS 102 or auxiliary system 104 or both. For example, a computer, data processing apparatus, or computer device of any type may be used in place of an SLS. The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments.

The data processing hardware includes a CPU for performing or executing instructions and one or more memory devices for storing instructions and data. Generally, a CPU can receive instructions and data from (and write data to) a memory. The data processing hardware can also include, or be operatively coupled to, one or more mass storage devices for storing data. In some implementations, the data processing hardware can receive data from, and transfer data to, the mass storage devices including, for example, magnetic, magneto optical disks, or optical disks. Moreover, the data processing hardware can be embedded in another device, for example, a desktop computer, a laptop computer, a mobile telephone, a personal digital assistant (PDA), a mobile audio or video player, a game console, a global positioning system (GPS) receiver, or a portable storage device such as a universal serial bus (USB) flash drive.

The data processing hardware may include or otherwise be coupled to computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLURAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry. The data processing hardware used in the control system 100 includes hardware and software that is operable to cause the control system 100 to operate as described, including, but not limited to, receiving signals from one or more pressure transduces; processing the received signals, such as by comparing the received signals to a predetermined value or values; and, in response to the signal processing, sending signals to cause other hardware to actuate, such as the actuation of an under-voltage relay to open or close a circuit breaker.

In some implementations, the auxiliary system 104 may be operated only during proof testing of the HIPS 102. That is, prior to initiating proof testing of the HIPS 102, the auxiliary system 104 may be engaged and placed in to an operational condition. In other implementations, the auxiliary system 104 may be operated continuously with the HIPS 102 even when proof testing is not being undertaken.

FIG. 2 is a schematic diagram showing another implementation of a control system 200. Similar to the control system 100, the control system 200 includes a HIPS 202 and an auxiliary system 204. Except as noted in the following, the HIPS 202 may operate in a manner similar to that of the HIPS 102, and the auxiliary system 204 may operate in a manner similar to that of the auxiliary system 104. In the illustrated example, the HIPS 202 operates at a level three SIL, and the auxiliary system 204 operates at a level two SIL. In other implementations, the HIPS 202 and auxiliary system 204 may operate with different SIL levels. Still further, in other implementations, the HIPS 202 and auxiliary system 204 may operate with the identical SIL levels.

The HIPS 202 includes an SLS 212 coupled to PTs 214, 216, and 218. Although pressure transducers are described, other sensors operable to detect pressure changes may also be used. The HIPS 202 also includes a first CB 220 and a second CB 222 coupled to a power line 206. Also part of the HIPS 202 is a first UVR 224 coupled to the first CB 220 and a second UVR 226 coupled to the second CB 222. The three PTs 214, 216, and 218 operate in a two-out-of-three ("2oo3") channel voting arrangement. The 2oo3 channel voting arrangement for the PTs is provided only as an example. In other implementations, other arrangements may be used and are within the scope of the present disclosure. For example, in some instances, any number of PTs may be used in any desired voting arrangement. The electrical line 206 provides power from a stepdown transformer 210. In this example, the stepdown transformer 210 steps down a higher voltage, such as 13.8 kV, to a lower voltage, such as 480 V. The lower voltage is used to operate the ESPs 208. However, in other implementations, the stepdown transformer 210 may be omitted.

The two CBs 220 and 222 and associated UVRs 224 and 226 form a one-out-of-two (1oo2) channel voting arrangement. While a 1oo2 channel voting arrangement is shown, other arrangements may also be used and are within the scope of the present disclosure. For example, in some implementations, a one-out-of-one (1oo1) channel voting arrangement may be used.

The auxiliary system 204 includes a test SLS 228 that receives pressure signals from PT 230. The PT 230 is arranged in a 1oo1 channel voting arrangement. The auxiliary system 204 also includes a CB 234 and an associated UVR 238. The CB 234 and associated UVR 238 form a 1oo1 channel voting arrangement. The CB 234 is arranged in a bypass 235 that bypasses CBs 220 and 222.

During proof testing of the HIPS 202, simulated test pressures that meet or exceed a predetermined pressure are sent to the SLS 212, causing the CBs 220 and 222 to open. The simulated pressure signals are sent to the SLS 212 via one or more or all of the PTs 214, 216, and 218. In some instances, one or more voltage measurements may be made across the CBs 220 and 222 to verify whether the CBs 220 and 222 are open or closed. In other implementations, one or more current measurements relative to the CBs 220 and 222 or one or more mechanical position indications relative to the CBs 220 and 222 may be made to verify on open or closed status of the CBs 220 and 222. The CB 234, though, remains closed. Consequently, electrical power bypasses the open CBs 220 and 222 via the closed CB 234 to provide electrical power to the ESPs 208. The electrical power remains supplied to the ESPs 208 so long as the sensed pressure from the PT 230 remains below a predetermined pressure. Therefore, the control system 200 maintains electrical power to the ESPs 208 during proof testing of the HIPS 202. Moreover, during proof testing of the HIPS 202, the auxiliary system 204 provides functional safety with an SIL just in case an actual overpressure condition occurs during proof testing of the HIPS 202. In this implementation, the auxiliary system 204 includes a level two SIL. However, the auxiliary system 204 may use any desired SIL. If such an overpressure condition does develop during proof testing of the HIPS 202, the auxiliary system 204 is operable to detect the overpressure condition and, in response, open CB 234. With CBs 220, 222, and 234 open, all power is cut off from ESPs 208.

Figure 3:
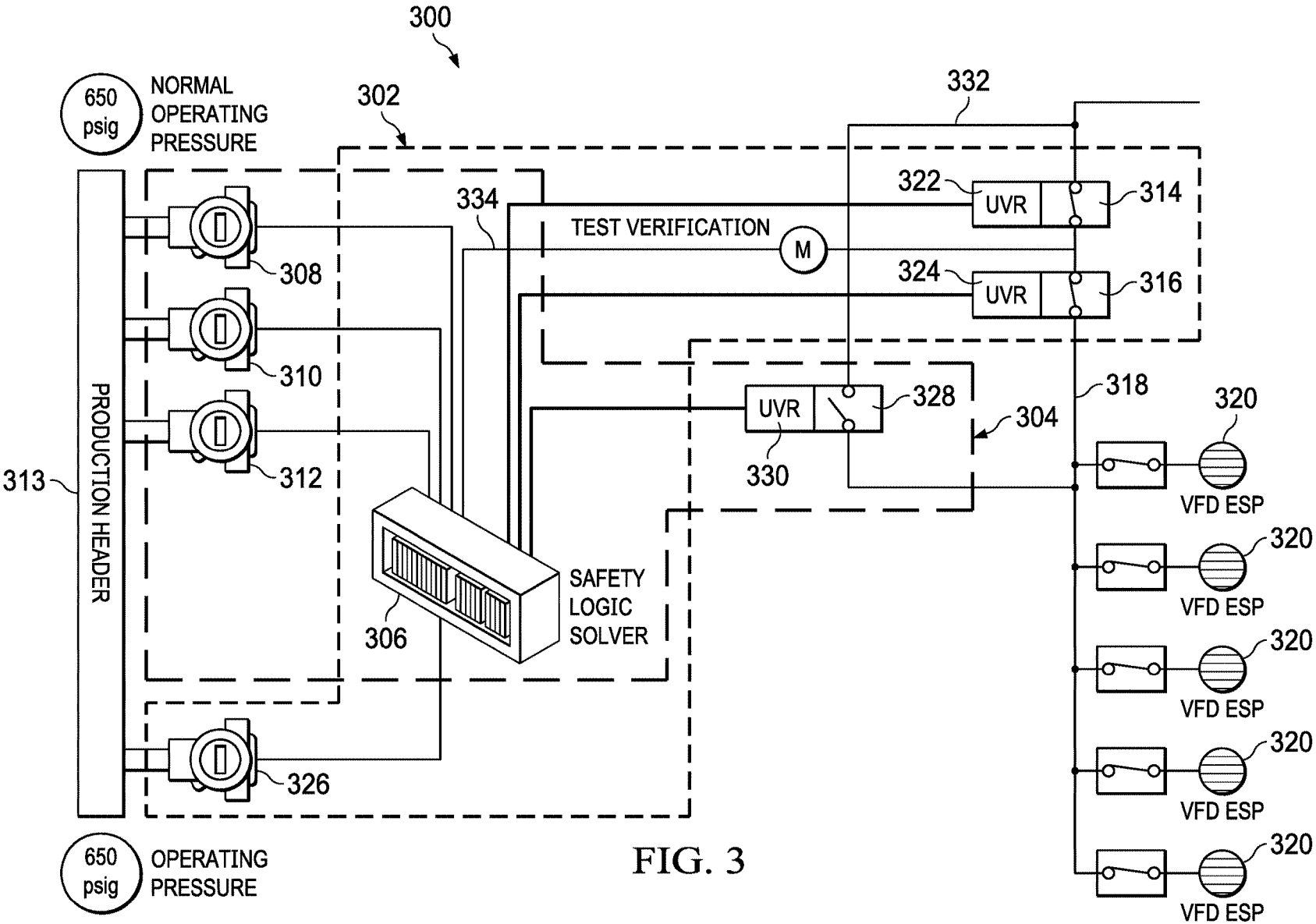
FIGS. 3-7 are schematic diagrams of another example control system shown at various instances during proof testing of a HIPS, according to some implementations of the present disclosure.

FIGS. 3-8 show another example control system and operation of the control system to maintain operation of pumps during proof testing of a HIPS. FIG. 3 is a schematic diagram of an example control system 300. The control system 300 includes a HIPS 302 and an auxiliary system 304. In some implementation, the control system 300 may operate on 480 volts. However, the scope is not so limited, and, in other implementations, the control system 300 may operate on a different voltage. In this example, the HIPS 302 operates at a level three SIL, and the auxiliary system 304 operates at a level two SIL. In other implementations, the HIPS 302 and auxiliary system 304 may operate with different SIL levels. In other implementations, the HIPS 302 and the auxiliary system 304 may operate with identical SIL levels. In this example, the HIPS 302 and the auxiliary system 304 share an integrated SLS 306. In this configuration, the SLS 306 performs the functionality of the HIPS 302 as well as the functionality of the auxiliary system 304 when the auxiliary system 304 is in operation. Although an SLS is described, any other data processing hardware, as described earlier, may be used. Also, in addition to pressure transducers, other types of sensors operable to detect pressure may be used.

The HIPS 302 also includes three pressure transducers, PTs 308, 310, and 312. The PTs 308, 310, and 312 operate in 2oo3 channel voting arrangement. Other voting arrangements may be used depending on a desired SIL. Also, the PTs 308, 310, and 312 may provide a four to 20 milliamperes (mA) analog input signal to the SLS 306. Other current or voltage ranges may be used in other implementations. In still other implementations, the PTs may include switches that utilize a digital signal for transmission to an SLS. Further, in some implementations, the PTs 308, 310, and 312 may use a digital signal. In the illustrated example, the PTs 308, 310, and 312 are disposed in a production header 313. In other implementations, the PTs may be disposed in any location in which the PTs are able to measure fluid pressure, such as downstream fluid pressure. The PTs 308, 310, and 312 sense fluid pressure within the production header 313. The sensed pressures are provided to SLS 306.

The HIPS 302 also includes a first CB 314 and a second CB 316 disposed in a power line 318. The power line 318 delivers electrical power to a plurality of ESPs 320. Although five ESPs 320 are illustrated, any number of ESPs may be included. A UVR 322 is associated with CB 314, and a UVR 324 is associated with CB 316. UVRs 322 and 324 receive signals from the SLS 306. The UVRs 322 and 324 function to energize and de-energize CB 314 and 316, respectively. In some implementations, the SLS 306 may use a 24 volt output signal to control operation of UVRs 322 and 324. In other implementations, the output signals provided by the SLS 306 to the UVRs 322 and 324 may have a different voltage.

The CBs 314 and 316 operate in a 1oo2 channel voting arrangement. Although two CBs and two UVRs are provided in the illustrated example, additional or fewer CBs and UVRs may be used. The number of CBs and UVRs that may be included may depend on the SIL desired. Any desired SIL may be used. Consequently, any voting arrangement may be used. Thus, other voting arrangements are possible in other implementations, all of which are within the scope of the present disclosure.

The auxiliary system 304 includes the shared SLS 306, a PT 326, a CB 328, and a UVR 330. In some implementations, the SLS 306 may use a 24 volt output signal to control operation of UVR 330. In other implementations, the output signals provided by the SLS 306 to the UVR 330 may have a different voltage. Further, in some implementations, the output signal may be a digital signal. The CB 328 and UVR 330 are disposed in a bypass 332 that bypasses the CBs 314 and 316. The PT 326 is disposed in the production header 313 to measure sense fluid pressure and operates in a 1oo1 channel voting arrangement. In other implementations, additional PTs may be used, and other voting arrangements may be used. In some implementations, the PT 326 is positioned to measure a downstream fluid pressure. In other implementations, the PT 326 may be disposed at another location to detect fluid pressure. The sensed fluid pressure is transmitted to the SLS 306. The SLS 306 transmits signals to the UVR 330 in response to the received pressure signal to cause the UVR 330 to energize or de-energize the CB 328. During proof testing of the HIPS 302, simulated pressure signals from one or more or all of PTs 308, 310, and 312 cause the SLS 306 to open CBs 314 and 316. If the PT 326 senses an overpressure condition, the SLS 306 opens CB 328. Consequently, an overpressure condition occurring during proof testing prevents electrical power from reaching ESPs 320.

FIG. 3 shows the control system 300 in a normal operating state and with HIPS 302 in operation. The CBs 314 and 316 are in a closed configuration in which electrical power is provided through the power line 318 to the ESPs 320. As a result, the ESPs 320 are operational and fluid production occurs. The auxiliary system 304 is in an inoperable state. As a consequence, the UVR 330 is de-energized, which results in the CB 328 being in an open configuration. As a result, no electrical power is conducted through the bypass 332. The PTs 308, 310, 312, and 326 detect a normal operating fluid pressure. In this example, the normal operating fluid pressure is 650 psig. However, 650 psig is used merely as an example. Normal operating pressures may be selected, for example, according to particular conditions of a particular system. In some instances, normal operating pressure may be a range of operating pressures.

The PTs 308, 310, and 312 of the HIPS 302 transmit the sensed pressure to the SLS 306 where the SLS 306 compares the sensed pressure with a predetermined pressure and determines whether the sensed pressure meets or exceeds the predetermined pressure. In this instance, the normal operating pressure sensed by the PTs is less than the predetermined pressure. As a consequence, HIPS 302 maintains UVRs 322 and 324 in an energized state, which, in turn, maintains CBs 314 and 316 in a closed configuration.

Figure 4:
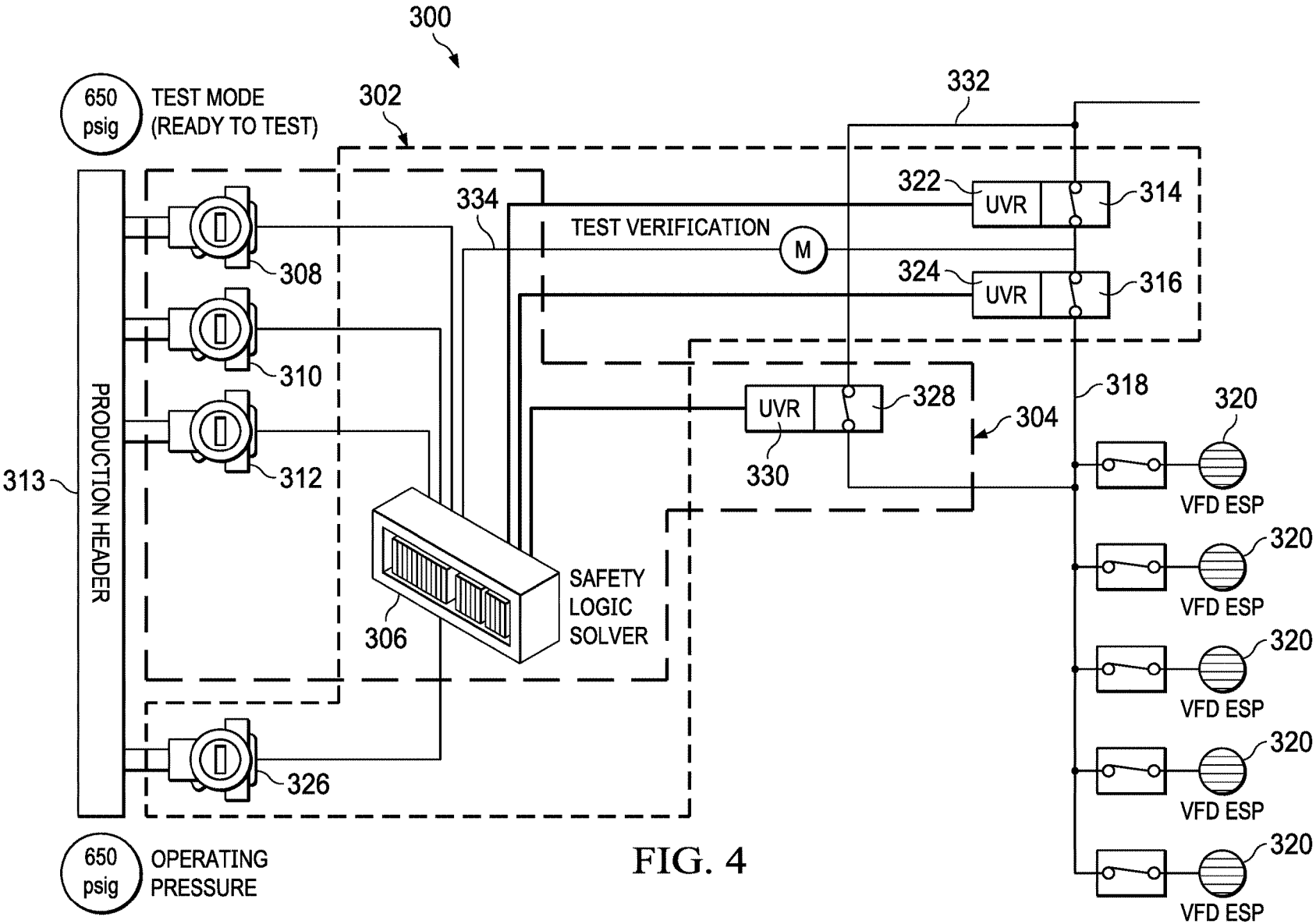

Referring now to FIG. 4, the control system 300 is prepared for proof testing of the HIPS 302. In some instances, the control system 300 may be prepared for proof testing by placing the SLS 306 into "ready-to-start" mode. The ready-to start mode places the SLS into a condition for a start of proof testing. As such, the auxiliary system 304 is engaged. As a result, the UVR 330 is energized, causing CB 328 to close. With the CB 328 closed, the bypass 332 forms a closed circuit, and electrical power from power line 318 is permitted to pass through the bypass 332. The fluid pressure sensed by the PTs 308, 310, 312, and 326 is a normal operating pressure. As shown, the sensed fluid pressure is 650 psig. With the sensed pressure below a predetermined pressure, the SLS 306 maintains the UVRs 322, 324, and 330 in an energized state, which maintains CBs 314, 316, and 328, respectively, in a closed configuration. Thus, electrical power is permitted to past through the CBs 314, 316, and 328 to power the ESPs 320. During proof testing, if a pressure in excess of a predetermined pressure is detected, the SLS 306 de-energizes UVR 330, causing CB 328 to open. In some implementations, if a pressure in excess of a predetermined pressure is detected, the SLS 306 de-energizes UVRs 322, 324, and 330, causing CBs 314, 316, and 328, respectively, to open.

Figure 5:
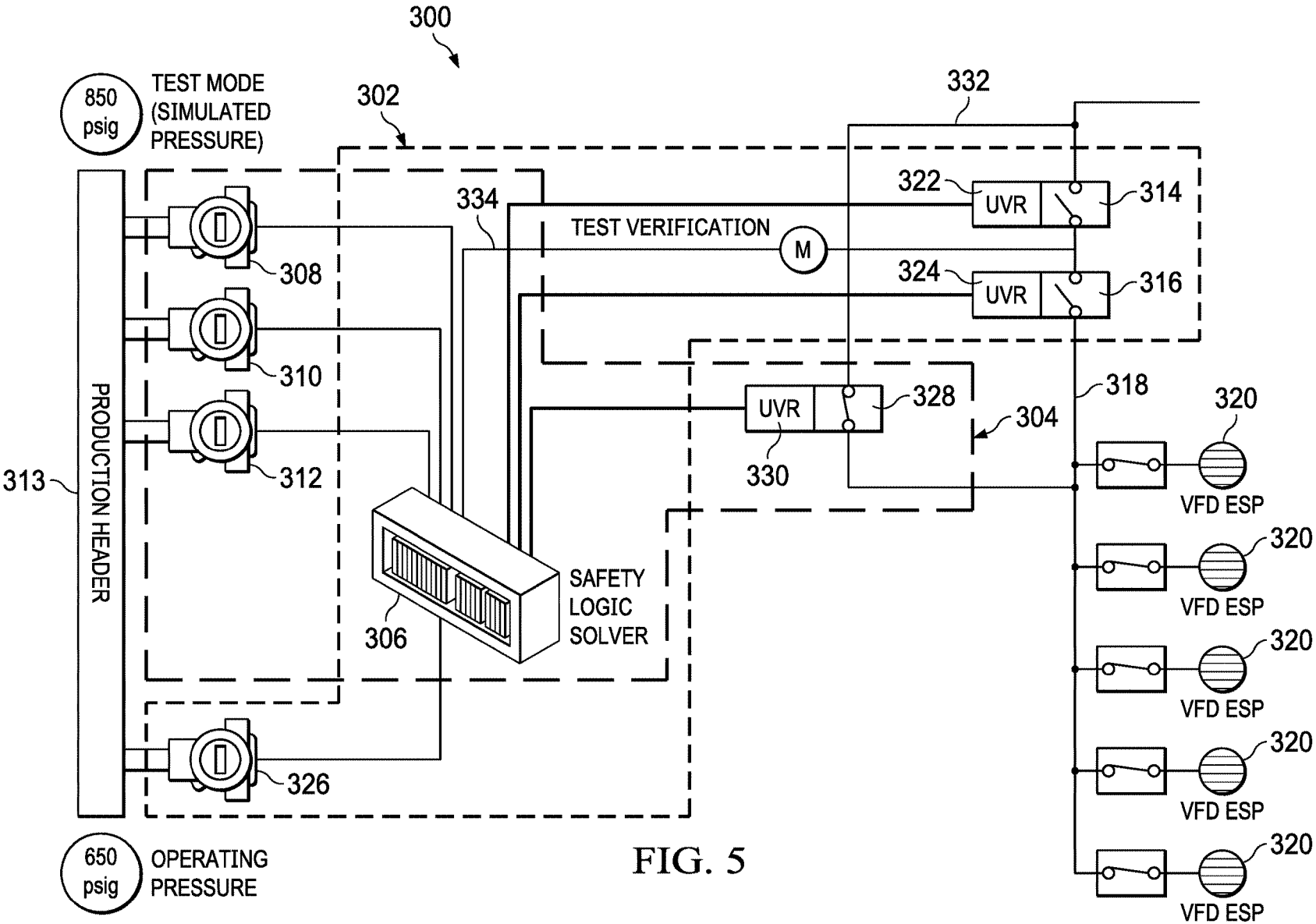

Referring now to FIG. 5, a simulated testing pressure is provided to HIPS 302. For example, the PTs 308, 310, and 312 may be made to sense or otherwise receive a simulated testing pressure that is above a predetermined fluid pressure stored in the SLS 306. In this particular example, the simulated testing pressure is 850 psig. However, this fluid pressure is used merely as an example. The SLS 306 compares the received fluid pressure to the predetermined fluid pressure. In this case, the received simulated fluid pressure exceeds the predetermined fluid pressure. As a result, detecting a simulated overpressure situation, the SLS 306 de-energizes UVRs 322 and 324, causing CBs 314 and 316 to open. With the CBs 314 and 316 open, electrical power is prevented from flowing to the ESPs 320 via the CBs 314 and 316. A voltage across the CBs 314 and 316 may be measured to verify whether the CBs 314 and 316 are open. A voltage sensor 334, schematically illustrated, is used to detect a voltage across CBs 314 and 316 to verify that the CBs 314 and 316 are open and responsive to the SLS 306. With the CBs 314 and 316 verified as open, the proof testing of HIPS 302 is completed, and the HIPS 302 is verified to be operating correctly. The voltage sensor 334 may provide a four to 20 mA analog input signal to the SLS 306. Other current or voltage ranges may be used in other implementations. Further, in some implementations, the voltage sensor 334 may use a digital signal.

Absent the auxiliary system 304, the open CBs 314 and 316 would cut off electrical power to the ESPs 320, thereby stopping production. However, as a result of the auxiliary system 304, electrical power is maintained to the ESPs 320 via the bypass 332 and closed CB 328. Therefore, the auxiliary system 304 is operable to maintain electrical power to the ESPs 320 during proof testing of the HIPS 302.

Figure 6:
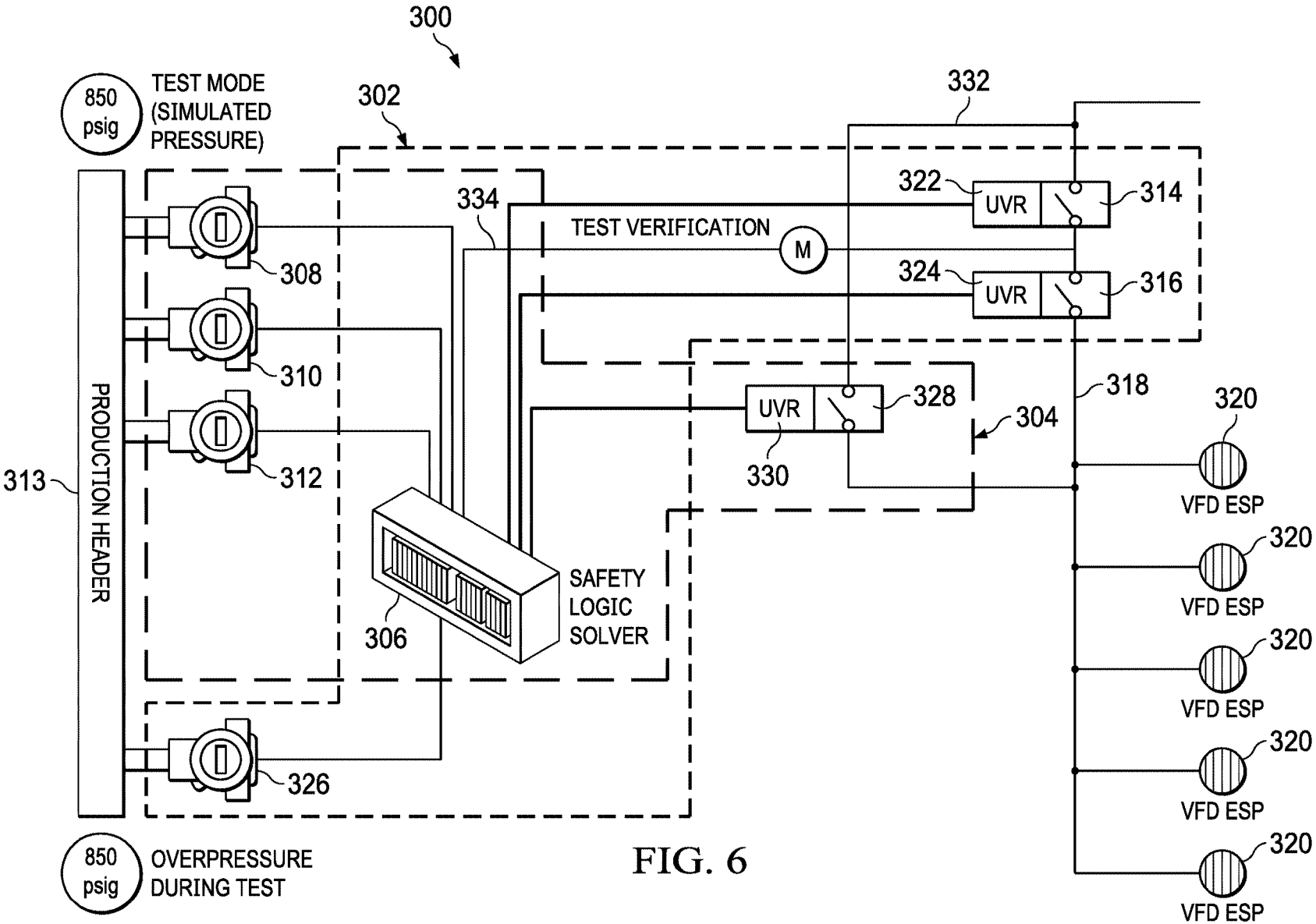

As proof testing is occurring, overpressure monitoring continues by the auxiliary system 304. The auxiliary system 304 continues to monitor fluid pressure with the PT 326 in a Tool channel voting arrangement. As mentioned earlier, in other implementations, additional PTs may be used in different voting arrangements. During proof testing, if the SLS 306 receives a fluid pressure from the PT 326 that exceeds the predetermined fluid pressure, as shown in FIG. 6, the SLS 306 de-energizes the UVR 330, opening the CB 328. As a result, electrical power is prevented from flowing through the bypass 332. With CB 328 open and the CBs 314 and 316 of the HIPS 302 open during proof testing, electrical power to the ESPs 320 is prevented, and the ESPs 320 cease operation. Fluid production ceases, and an overpressure condition is avoided. In other implementations, if the SLS 306 receives a fluid pressure from the PT 326 that exceeds the predetermined fluid pressure, as shown in FIG. 6, the SLS 306 de-energizes the UVR 330 and UVRs 322 and 324 to ensure that all CBs 314, 316, and 328 open. This ensures electrical power to ESPs 320 is prevented.

Figure 7:
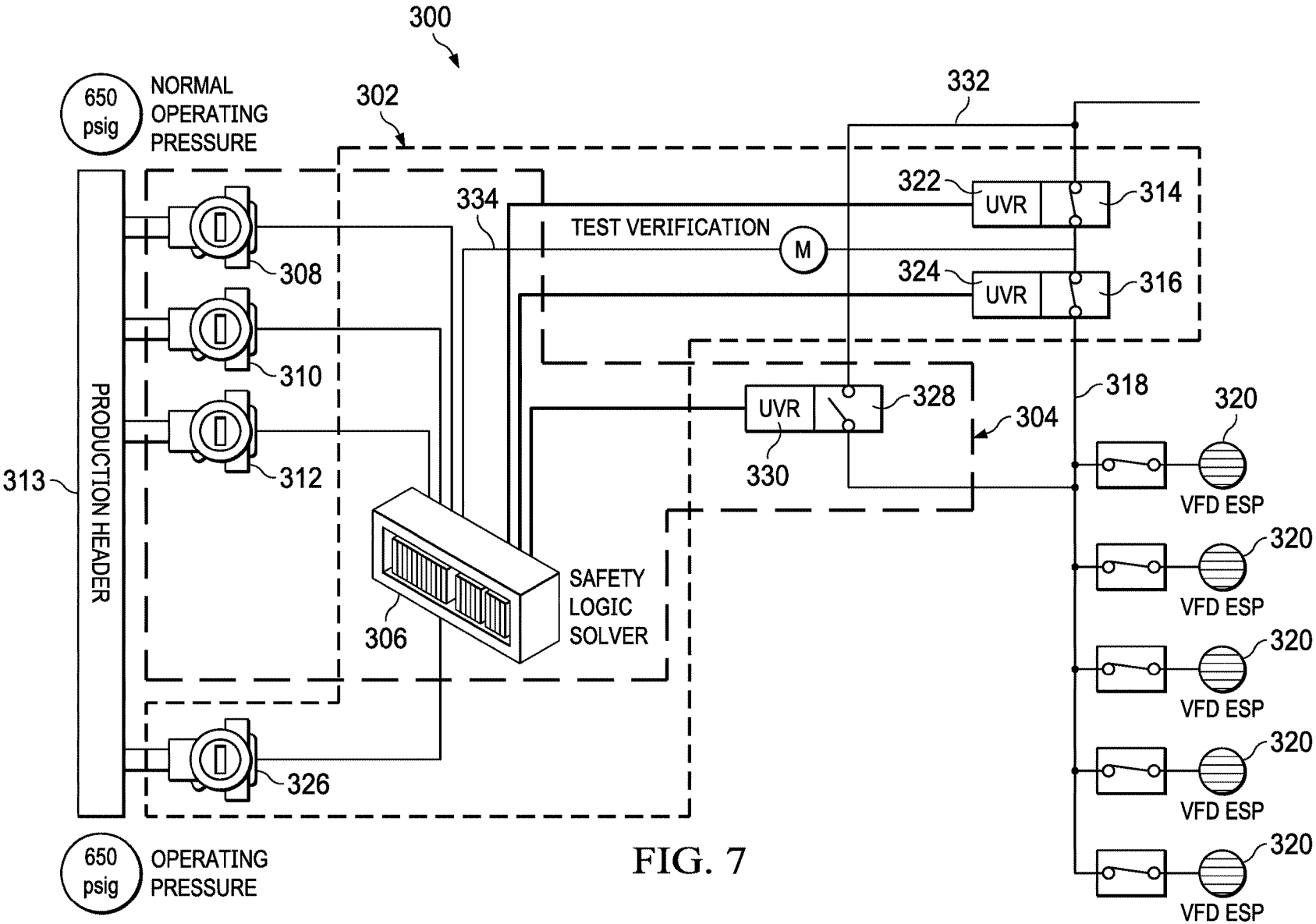

Referring to FIG. 7, proof testing is concluded and the HIPS 302 is restored to normal operation. In some implementations, the system 300 may be returned to normal operation by placing SLS 306 in normal operating mode. With a normal fluid operating pressure (that is, a fluid pressure below the predetermined fluid pressure that is indicative of an overpressure condition or an indication of a precipitating overpressure condition) sensed by the PTs 308, 310, and 312, the SLS 306 maintains UVRs 322 and 324 in an energized state, which results in the CBs 314 and 316 being in a closed configuration. With CBs 314 and 316 closed, electrical power is provided to the ESPs 320 via electrical line 318. Further, with HIPS 302 operating normally, the auxiliary system 304 may be disengaged or placed in an inoperative condition. With auxiliary system 304 disengaged, UVR 330 is de-energized, and CB 328 is in an open configuration. Consequently, electrical power is prevented from flowing through bypass 332.

In some implementations, placing the SLS 306 in normal operating mode may immediately disengage the auxiliary system 304 and de-energizing the UVR 330 to open CB 328. In other implementations, during proof testing, the auxiliary system 304 may have a timer feature that disengages the auxiliary system 304 after a selected period of time has elapsed. In still other implementations, the SLS 306 may include a timer features that automatically places the SLS 306 back into normal operating mode after a selected time period has elapsed after the SLS 306 was placed into proof test start mode. Such a feature may avoid leaving the system 300 in test mode due to human error, for example. In other implementations, operation of the CBs associated with the HIPS or the auxiliary system, or both, may be performed remotely.

Figure 8:
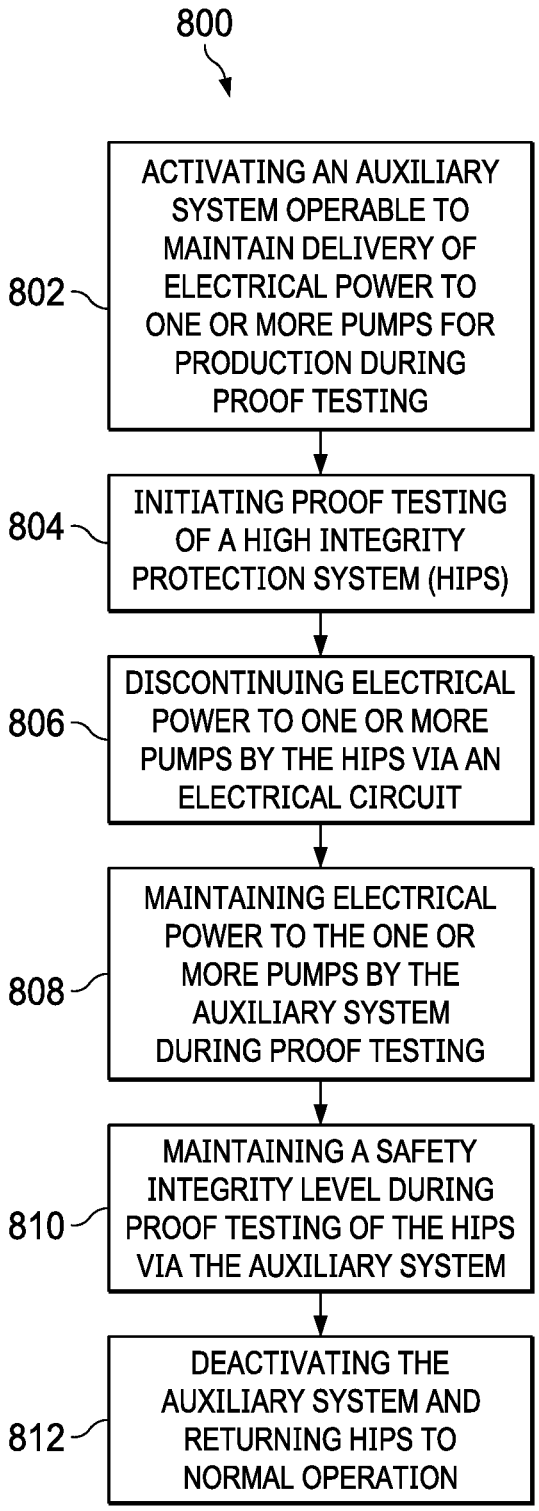
FIG. 8 is a flowchart of an example method of maintaining production during proof testing of a HIPS, according to some implementations of the present disclosure.

FIG. 8 is a flowchart for an example method 800 of maintaining production during proof testing of a HIPS. At 802, an auxiliary system is activated. In some implementations, the auxiliary system may be activated for a set period of time and then automatically deactivate. In other implementations, the auxiliary system may remain activated until being deactivated. The activated auxiliary system is operable to maintain delivery of electrical power to one or more pumps for production during HIPS proof testing. Activation of the auxiliary system may include closing of one or more circuit breakers to complete an electrical circuit. In some implementations, closing the one or more circuit breakers may involve energizing one or more under-voltage relays. At 804, proof testing of a HIPS is initiated. Initiation of the proof testing may include sending a signal indicative of an overpressure condition to data processing hardware, such as an SLS. The data processing hardware determines the presence of an overpressure condition based on the received signal. At 806, the HIPS discontinue flow of electrical power to the one or more pumps through an electrical circuit. In some implementations, the HIPS opens an electrical circuit between a power source and the one or more pumps. In some implementations, the opening of an electrical circuit may include opening one or more circuit breakers along an electrical circuit. The circuit breakers may be opened by de-energizing an under-voltage relay coupled to the circuit breakers. At 808, electrical power is maintained to the one or more pumps by the auxiliary system. The auxiliary system may maintain electrical power to the one or more pumps via an alternate electric circuit. The one or more closed circuit breakers of the auxiliary system may be disposed in a bypass electrical circuit that bypasses the electrical circuit opened by the HIPS so that electrical power is maintained to the one or more pumps.

At 810, an SIL is maintained during HIPS proof testing. In some implementations, the auxiliary system may include one or more sensors operable to detect a fluid pressure of the production. If an overpressure actual condition is detected, the auxiliary system is operable to discontinue electrical power to the one or more pumps to cease operation of the one or more pumps and, as a result, cease production. In some implementations, the auxiliary system opens one or more circuit breakers to discontinue electrical power. In some implementations, the auxiliary system opens the one or more circuit breakers by de-energizing one or more under-voltage relays. In some implementations, the auxiliary system may open circuit breakers in both a primary electrical path and a bypass electrical path to prevent electrical power from reaching the one or more pumps. At 812, the auxiliary system is deactivated and the HIPS is returned to normal operation.

Figure 9:
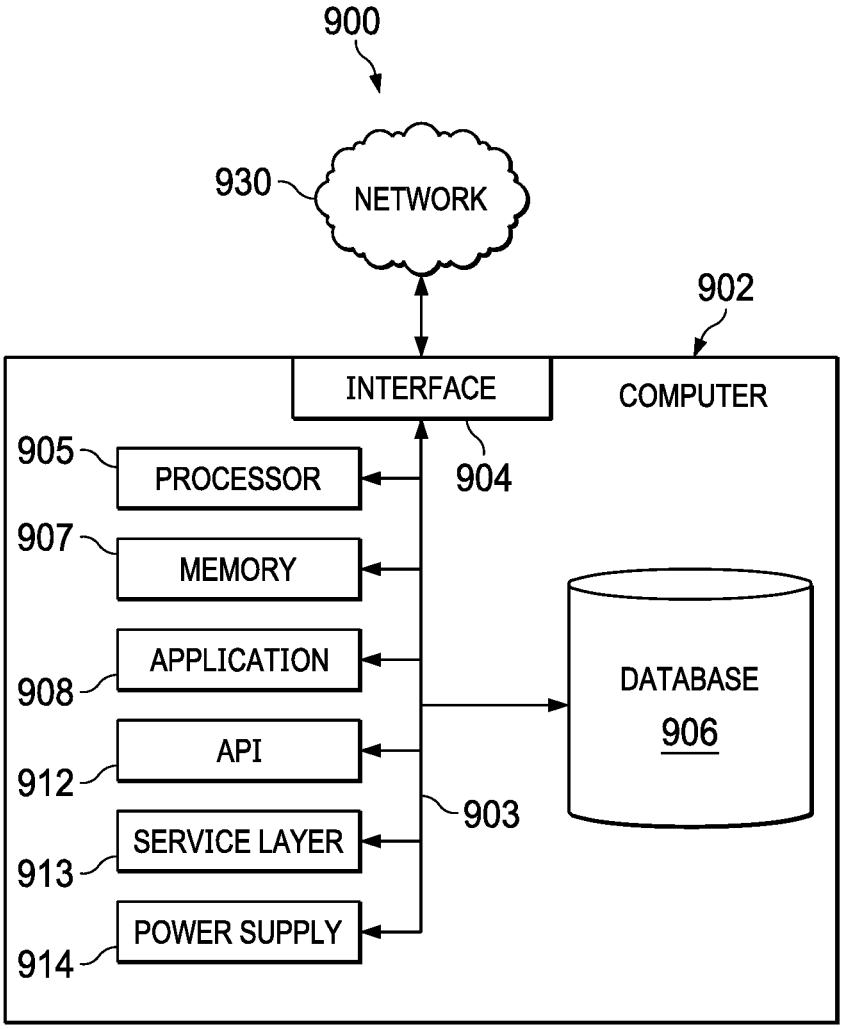
FIG. 9 is a block diagram illustrating an example computer system used to provide computational functionalities associated with described algorithms, methods, functions, processes, flows, and procedures as described in the present disclosure, according to some implementations of the present disclosure.

FIG. 9 is a block diagram of an example computer system 900 used to provide computational functionalities associated with described algorithms, methods, functions, processes, flows, and procedures described in the present disclosure, according to some implementations of the present disclosure. The illustrated computer 902 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 902 can include input devices such as keypads, keyboards, and touch screens that can accept user information. Also, the computer 902 can include output devices that can convey information associated with the operation of the computer 902. The information can include digital data, visual data, audio information, or a combination of information. The information can be presented in a graphical user interface (UI) (or GUI).

The computer 902 can serve in a role as a client, a network component, a server, a database, a persistency, or components of a computer system for performing the subject matter described in the present disclosure. The illustrated computer 902 is communicably coupled with a network 930. In some implementations, one or more components of the computer 902 can be configured to operate within different environments, including cloud-computing-based environments, local environments, global environments, and combinations of environments.

At a high level, the computer 902 is an electronic computing device operable to receive, transmit, process, store, and manage data and information associated with the described subject matter. According to some implementations, the computer 902 can also include, or be communicably coupled with, an application server, an email server, a web server, a caching server, a streaming data server, or a combination of servers.

The computer 902 can receive requests over network 930 from a client application (for example, executing on another computer 902). The computer 902 can respond to the received requests by processing the received requests using software applications. Requests can also be sent to the computer 902 from internal users (for example, from a command console), external (or third) parties, automated applications, entities, individuals, systems, and computers.

Each of the components of the computer 902 can communicate using a system bus 903. In some implementations, any or all of the components of the computer 902, including hardware or software components, can interface with each other or the interface 904 (or a combination of both), over the system bus 903. Interfaces can use an application programming interface (API) 912, a service layer 913, or a combination of the API 912 and service layer 913. The API 912 can include specifications for routines, data structures, and object classes. The API 912 can be either computer-language independent or dependent. The API 912 can refer to a complete interface, a single function, or a set of APIs.

The service layer 913 can provide software services to the computer 902 and other components (whether illustrated or not) that are communicably coupled to the computer 902. The functionality of the computer 902 can be accessible for all service consumers using this service layer. Software services, such as those provided by the service layer 913, can provide reusable, defined functionalities through a defined interface. For example, the interface can be software written in JAVA, C++, or a language providing data in extensible markup language (XML) format. While illustrated as an integrated component of the computer 902, in alternative implementations, the API 912 or the service layer 913 can be stand-alone components in relation to other components of the computer 902 and other components communicably coupled to the computer 902. Moreover, any or all parts of the API 912 or the service layer 913 can be implemented as child or sub-modules of another software module, enterprise application, or hardware module without departing from the scope of the present disclosure.

The computer 902 includes an interface 904. Although illustrated as a single interface 904 in FIG. 9, two or more interfaces 904 can be used according to particular needs, desires, or particular implementations of the computer 902 and the described functionality. The interface 904 can be used by the computer 902 for communicating with other systems that are connected to the network 930 (whether illustrated or not) in a distributed environment. Generally, the interface 904 can include, or be implemented using, logic encoded in software or hardware (or a combination of software and hardware) operable to communicate with the network 930. More specifically, the interface 904 can include software supporting one or more communication protocols associated with communications. As such, the network 930 or the interface's hardware can be operable to communicate physical signals within and outside of the illustrated computer 902.

The computer 902 includes a processor 905. Although illustrated as a single processor 905 in FIG. 9, two or more processors 905 can be used according to particular needs, desires, or particular implementations of the computer 902 and the described functionality. Generally, the processor 905 can execute instructions and can manipulate data to perform the operations of the computer 902, including operations using algorithms, methods, functions, processes, flows, and procedures as described in the present disclosure.

The computer 902 also includes a database 906 that can hold data for the computer 902 and other components connected to the network 930 (whether illustrated or not). For example, database 906 can be an in-memory, conventional, or a database storing data consistent with the present disclosure. In some implementations, database 906 can be a combination of two or more different database types (for example, hybrid in-memory and conventional databases) according to particular needs, desires, or particular implementations of the computer 902 and the described functionality. Although illustrated as a single database 906 in FIG. 9, two or more databases (of the same, different, or combination of types) can be used according to particular needs, desires, or particular implementations of the computer 902 and the described functionality. While database 906 is illustrated as an internal component of the computer 902, in alternative implementations, database 906 can be external to the computer 902.

The computer 902 also includes a memory 907 that can hold data for the computer 902 or a combination of components connected to the network 930 (whether illustrated or not). Memory 907 can store any data consistent with the present disclosure. In some implementations, memory 907 can be a combination of two or more different types of memory (for example, a combination of semiconductor and magnetic storage) according to particular needs, desires, or particular implementations of the computer 902 and the described functionality. Although illustrated as a single memory 907 in FIG. 9, two or more memories 907 (of the same, different, or combination of types) can be used according to particular needs, desires, or particular implementations of the computer 902 and the described functionality. While memory 907 is illustrated as an internal component of the computer 902, in alternative implementations, memory 907 can be external to the computer 902.

The application 908 can be an algorithmic software engine providing functionality according to particular needs, desires, or particular implementations of the computer 902 and the described functionality. For example, application 908 can serve as one or more components, modules, or applications. Further, although illustrated as a single application 908, the application 908 can be implemented as multiple applications 908 on the computer 902. In addition, although illustrated as internal to the computer 902, in alternative implementations, the application 908 can be external to the computer 902.

The computer 902 can also include a power supply 914. The power supply 914 can include a rechargeable or non-rechargeable battery that can be configured to be either user- or non-user-replaceable. In some implementations, the power supply 914 can include power-conversion and management circuits, including recharging, standby, and power management functionalities. In some implementations, the power-supply 914 can include a power plug to allow the computer 902 to be plugged into a wall socket or a power source to, for example, power the computer 902 or recharge a rechargeable battery.

There can be any number of computers 902 associated with, or external to, a computer system containing computer 902, with each computer 902 communicating over network 930. Further, the terms "client," "user," and other appropriate terminology can be used interchangeably, as appropriate, without departing from the scope of the present disclosure. Moreover, the present disclosure contemplates that many users can use one computer 902 and one user can use multiple computers 902.

Described implementations of the subject matter can include one or more features, alone or in combination.

For example, in a first implementation, a computer-implemented method, including forming a bypass of a first electrical path that extends between a power source and a pump, the first electrical path being selectively opened or closed by the HIPS in response to a pressure condition of the production fluid flow; initiating proof testing of the HIPS such that the HIPS detects an overpressure condition and opens the first electrical path; and maintaining flow of electrical power from the power source to the pump along the bypass when the first electrical path is open.

The foregoing and other described implementations can each, optionally, include one or more of the following features:

A first feature, combinable with any of the following features, wherein forming a bypass of the first electrical path includes closing a circuit breaker disposed on a second electrical path that bypasses the first electrical path, the closed circuit breaker permitting flow of electrical power along the second electrical path.

A second feature, combinable with any of the previous or following features, wherein initiating proof testing of the HIPS includes receiving a simulated production fluid pressure signal by the HIPS; comparing the simulated production fluid pressure signal to a predetermined fluid pressure indicative of an overpressure condition; and opening the first electrical path to prevent passage of electrical power along the first electrical path when the simulated production fluid pressure meets or exceeds the predetermined fluid pressure.

A third feature, combinable with any of the previous or following features, wherein receiving a simulated production fluid pressure signal by the HIPS includes receiving the simulated production fluid pressure from a first pressure sensor of the HIPS by a data processor of the HIPS; wherein comparing the simulated production fluid pressure to the predetermined fluid pressure indicative of an overpressure condition includes comparing the simulated fluid pressure to the predetermined fluid pressure with the data processor; and wherein opening the first electrical path to prevent passage of electrical power along the first electrical path when the simulated production fluid pressure meets or exceeds the predetermined fluid pressure includes opening a circuit breaker in the first electrical path in response to a signal sent by the data processor.

A fourth feature, combinable with any of the previous or following features, wherein the first pressure sensor forms a part of a two-out-of-three (2oo3) channel voting arrangement.

A fifth feature, combinable with any of the previous or following features, wherein the circuit breaker forms a part of a one-out-of-two (1oo2) channel voting arrangement.

A sixth feature, combinable with any of the previous or following features, the method further including continuing to monitor a pressure of the production fluid flow with an auxiliary system comprising a circuit breaker disposed in the bypass, a pressure sensor operable to sense the pressure of the production fluid flow, and a data processor operably coupled to the pressure sensor and the bypass.

A seventh feature, combinable with any of the previous or following features, wherein continuing to monitor the pressure of the production fluid flow includes sensing the pressure of the production fluid flow with the pressure sensor; comparing the sensed pressure of the production fluid flow with a predetermined fluid pressure indicative of an overpressure condition; and opening the circuit breaker to prevent flow of electrical power along the bypass when the sensed pressure of the production fluid flow meets or exceeds the predetermined fluid pressure.

An eighth feature, combinable with any of the previous or following features, wherein opening the circuit breaker includes de-energizing an under-voltage relay coupled to the circuit breaker.

In a second implementation, a non-transitory, computer-readable medium storing one or more instructions executable by a computer system to perform operations including: forming a bypass of a first electrical path that extends between a power source and a pump, the first electrical path being selectively opened or closed by the HIPS in response to a pressure condition of the production fluid flow; initiating proof testing of the HIPS such that the HIPS detects an overpressure condition and opens the first electrical path; and maintaining flow of electrical power from the power source to the pump along the bypass when the first electrical path is open.

The foregoing and other described implementations can each, optionally, include one or more of the following features:

A first feature, combinable with any of the following features, wherein forming a bypass of the first electrical path includes closing a circuit breaker disposed on a second electrical path that bypasses the first electrical path, the closed circuit breaker permitting flow of electrical power along the second electrical path.

A second feature, combinable with any of the previous or following features, wherein initiating proof testing of the HIPS includes receiving an simulated production fluid pressure signal by the HIPS; comparing the simulated production fluid pressure signal to a predetermined fluid pressure indicative of an overpressure condition; and opening the first electrical path to prevent passage of electrical power along the first electrical path when the simulated production fluid pressure meets or exceeds the predetermined fluid pressure.

A third feature, combinable with any of the previous or following features, wherein receiving an simulated production fluid pressure signal by the HIPS includes receiving the simulated production fluid pressure from a first pressure sensor of the HIPS by a data processor of the HIPS; wherein comparing the simulated production fluid pressure to the predetermined fluid pressure indicative of an overpressure condition includes comparing the simulated fluid pressure to the predetermined fluid pressure with the data processor; and wherein opening the first electrical path to prevent passage of electrical power along the first electrical path when the simulated production fluid pressure meets or exceeds the predetermined fluid pressure includes opening a circuit breaker in the first electrical path in response to a signal sent by the data processor.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

A number of embodiments of the present disclosure have been described. Nevertheless, it will be understood that various modifications may be made without departing from the spirit and scope of the present disclosure. For example, pump types other than an electric submersible pump may be used. Accordingly, other embodiments are within the scope of the following claims.

What is claimed is:

1. A control system for maintaining a production fluid flow during proof testing of a High Integrity Protection System (HIPS), the control system comprising:

a HIPS comprising:

a first pressure sensor operable to sense a fluid pressure of the production fluid flow;

a first circuit breaker operable selectively to open to prevent a flow of electrical power along the first electrical path or close to permit the flow of electrical power along the first electrical path; and a first data processor, the data processor operable to:

receive a first pressure signal from the first pressure sensor, the pressure signal indicative of a fluid pressure of a production fluid flow;

compare the received first pressure signal to a predetermined fluid pressure to determine the presence of an overpressure condition of the production fluid flow; and open the first circuit breaker to discontinue the production fluid flow if the received first pressure signal meets or exceeds the predetermined fluid pressure; and an auxiliary system comprising a second circuit breaker arranged in a bypass of the first electrical path, the second circuit breaker operable selectively to open to prevent a flow of electrical power along the bypass and close to permit the flow of electrical power along the bypass, the auxiliary system operable to close the second circuit breaker prior to the first circuit breaker being opened by the first data processor in response to a test pressure signal received by the first data processor from the first pressure sensor during the proof test.

2. The control system of claim 1, wherein the auxiliary system further comprises a second data processor and a second pressure sensor, the second data processor operable to receive a pressure signal from the second pressure signal of the production fluid flow during the HIPS proof testing, the second data processor operable to open the second circuit breaker when the second pressure signal exceeds the predetermined fluid pressure.

3. The control system of claim 2, wherein the first data processor and the second data processor comprise the same data processor.

4. The control system of claim 1, wherein the HIPS comprises a third circuit breaker coupled to the first data processor, and wherein the first circuit breaker and the third circuit breaker operate in a one-out-of-two (1oo2) channel voting arrangement.

5. The control system of claim 1, wherein the HIPS comprises a third pressure sensor coupled to the first data processor, and wherein the first pressure sensor and the second pressure sensor operate in a 1oo2 channel voting arrangement.

6. The control system of claim 5, wherein the HIPS comprises a fourth pressure sensor coupled to the first data processor, and wherein the first pressure sensor, the third pressure sensor, and the fourth pressure sensor operate in a two-out-of-three (2oo3) channel voting arrangement.

7. The control system of claim 1, wherein the first pressure sensor and the second pressure sensor are pressure transducers.

8. The control system of claim 1 further comprising an electric submersible pump, the electric submersible pump operable to generate the production fluid flow, wherein the electric submersible pump is coupled to the first electrical path and the bypass.

9. A method of maintaining a production fluid flow during proof testing of a High Integrity Protection System (HIPS), the method comprising:

forming a bypass of a first electrical path that extends between a power source and a pump, the first electrical path being selectively opened or closed by the HIPS in response to a pressure condition of the production fluid flow;

initiating proof testing of the HIPS such that the HIPS detects an overpressure condition and opens the first electrical path; and maintaining flow of electrical power from the power source to the pump along the bypass prior to the first electrical path being opened.

10. The method of claim 9, wherein forming a bypass of the first electrical path comprises closing a circuit breaker disposed on a second electrical path that bypasses the first electrical path, the closed circuit breaker permitting flow of electrical power along the second electrical path.

11. The method of claim 9, wherein initiating proof testing of the HIPS comprises:

receiving a simulated production fluid pressure signal by the HIPS;

comparing the simulated production fluid pressure signal to a predetermined fluid pressure indicative of an overpressure condition; and opening the first electrical path to prevent passage of electrical power along the first electrical path when the simulated production fluid pressure meets or exceeds the predetermined fluid pressure.

12. The method of claim 11, wherein receiving a simulated production fluid pressure signal by the HIPS comprises receiving the simulated production fluid pressure from a first pressure sensor of the HIPS by a data processor of the HIPS;

wherein comparing the simulated production fluid pressure to the predetermined fluid pressure indicative of an overpressure condition comprises comparing the simulated fluid pressure to the predetermined fluid pressure with the data processor; and wherein opening the first electrical path to prevent passage of electrical power along the first electrical path when the simulated production fluid pressure meets or exceeds the predetermined fluid pressure comprises opening a circuit breaker in the first electrical path in response to a signal sent by the data processor.

13. The method of claim 12, wherein the first pressure sensor forms a part of a two-out-of-three (2oo3) channel voting arrangement.

14. The method of claim 12, wherein the circuit breaker forms a part of a one-out-of-two (1oo2) channel voting arrangement.

15. The method of claim 9, further comprising continuing to monitor a pressure of the production fluid flow with an auxiliary system comprising a circuit breaker disposed in the bypass, a pressure sensor operable to sense the pressure of the production fluid flow, and a data processor operably coupled to the pressure sensor and the bypass, wherein continuing to monitor the pressure of the production fluid flow comprises:

sensing the pressure of the production fluid flow with the pressure sensor;

comparing the sensed pressure of the production fluid flow with a predetermined fluid pressure indicative of an overpressure condition; and opening the circuit breaker to prevent flow of electrical power along the bypass when the sensed pressure of the production fluid flow meets or exceeds the predetermined fluid pressure.

16. The method of claim 15, wherein opening the circuit breaker comprises de-energizing an under-voltage relay coupled to the circuit breaker.

17. A computer program product encoded on a non-transitory medium, the product comprising computer readable instructions for causing one or more processors to perform operations comprising:

forming a bypass of a first electrical path that extends between a power source and a pump, the first electrical path being selectively opened or closed by the HIPS in response to a pressure condition of the production fluid flow;

initiating proof testing of the HIPS such that the HIPS detects an overpressure condition and opens the first electrical path; and maintaining flow of electrical power from the power source to the pump along the bypass when the first electrical path is open.

18. The computer program product of claim 17, wherein forming a bypass of the first electrical path comprises closing a circuit breaker disposed on a second electrical path that bypasses the first electrical path, the closed circuit breaker permitting flow of electrical power along the second electrical path.

19. The computer program product of claim 17, wherein initiating proof testing of the HIPS comprises:

receiving an simulated production fluid pressure signal by the HIPS;

comparing the simulated production fluid pressure signal to a predetermined fluid pressure indicative of an overpressure condition; and opening the first electrical path to prevent passage of electrical power along the first electrical path when the simulated production fluid pressure meets or exceeds the predetermined fluid pressure.

20. The computer program product of claim 19, wherein receiving an simulated production fluid pressure signal by the HIPS comprises receiving the simulated production fluid pressure from a first pressure sensor of the HIPS by a data processor of the HIPS;

wherein comparing the simulated production fluid pressure to the predetermined fluid pressure indicative of an overpressure condition comprises comparing the simulated fluid pressure to the predetermined fluid pressure with the data processor; and wherein opening the first electrical path to prevent passage of electrical power along the first electrical path when the simulated production fluid pressure meets or exceeds the predetermined fluid pressure comprises opening a circuit breaker in the first electrical path in response to a signal sent by the data processor.

* * * * *